US012207770B1

(12) United States Patent
Heidebrink

(10) Patent No.: US 12,207,770 B1
(45) Date of Patent: Jan. 28, 2025

(54) SHOWER CURTAIN ROD HIDEAWAY

(71) Applicant: Steven Glenn Heidebrink, Santa Rosa, CA (US)

(72) Inventor: Steven Glenn Heidebrink, Santa Rosa, CA (US)

( * ) Notice: Subject to any disclaimer, the term of this patent is extended or adjusted under 35 U.S.C. 154(b) by 0 days.

(21) Appl. No.: 18/227,819

(22) Filed: Jul. 28, 2023

(51) Int. Cl.
*A47K 3/38* (2006.01)

(52) U.S. Cl.
CPC ..... *A47K 3/38* (2013.01)

(58) Field of Classification Search
CPC ... A47K 3/30; A47K 3/38; A47H 1/02; A47H 1/022; A47H 1/03; A47H 1/122
See application file for complete search history.

(56) References Cited

U.S. PATENT DOCUMENTS 1,732,798 A * 10/1929 Falzer ..... A47K 3/38 4/558
5,242,063 A * 9/1993 Ericksen ..... A47K 3/281 248/205.2
5,305,477 A * 4/1994 Cochran ..... A47K 3/38 4/607
5,794,281 A 8/1998 Shearon
6,435,254 B1 * 8/2002 Todd ..... A47K 3/38 160/313
6,836,909 B1 1/2005 Kirsopp
2014/0289957 A1 10/2014 Whittaker
2015/0327729 A1 11/2015 Tarnowski
2021/0267420 A1 * 9/2021 Kaule ..... A61L 2/10

FOREIGN PATENT DOCUMENTS

GB 2330301 4/2002
WO 2008035095 3/2008

* cited by examiner

*Primary Examiner* — Janie M Loeppke
(74) *Attorney, Agent, or Firm* — My Patent Guys; Christopher Pilling

(57) ABSTRACT

The present invention relates to a shower curtain rod hideaway designed for installation in a shower stall or tub enclosure. The assembly comprises an in-wall storage container with a door, a shower rod configured to be stowed within the storage container when not in use, and a shower curtain coupled to the rod. The shower rod, which includes a proximal end secured by a cylindrical joint in the storage container, is capable of rotating from a vertical to a horizontal position. A securement element located on an opposing wall in the enclosure is designed to hold the distal end of the shower rod in the horizontal position. The in-wall storage container, which can extend below the top of a tub, allows for the curtain to hang without bunching at the bottom, and is constructed with a material resistant to mold growth. The design of this assembly provides an aesthetic and functional solution to managing shower curtains, reducing visible clutter when not in use.

6 Claims, 7 Drawing Sheets

SHOWER CURTAIN ROD HIDEAWAY

CROSS-REFERENCE TO RELATED APPLICATIONS

N/A

BACKGROUND OF THE INVENTION

1. Field of the Invention

The present invention relates to concealing assemblies but more particularly a shower curtain rod hideaway.

2. Description of Related Art

Bathrooms are key functional spaces in any dwelling, and their design and usability directly influence the occupant's experience. Among the many considerations for a functional bathroom, managing water during a shower is of paramount importance. This is typically achieved using either a shower curtain or a fixed glass enclosure.

The traditional solution involves the use of a shower curtain rod with an attached shower curtain. This system, while functional, has notable drawbacks. One such limitation is its aesthetic appeal. A hanging shower curtain can often create a sense of clutter, detracting from the overall aesthetic of the bathroom. Furthermore, the curtain, when left extended, can trap moisture, potentially leading to the growth of mold and mildew.

An alternative to the shower curtain is a fixed glass enclosure with a door, either hinged or slidable. Glass enclosures provide a more modern and streamlined appearance compared to shower curtains. However, they come with their own set of challenges. Glass enclosures are often more expensive and require professional installation. They are also harder to maintain, as they can accumulate water spots and soap scum, necessitating regular cleaning.

In light of the above, there is a clear need for a system that combines the practicality and ease of a shower curtain with the aesthetic and cleanliness of a glass enclosure. It would be highly beneficial to have a solution that is visually appealing, easy to maintain, and helps prevent issues like mold growth. Such a solution would be a significant advancement in the field of bathroom fixtures. Consequently, a solution is provided.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention pertains to a novel shower curtain rod hideaway designed to enhance aesthetic appeal and functionality in a bathroom setting. The assembly primarily comprises an in-wall storage container, a rotatable shower rod, and a shower curtain. The in-wall storage container, installed in a shower stall or tub enclosure, is equipped with a door and is designed to house the shower rod and curtain when not in use. The shower rod, featuring a perpendicular section at the proximal end, is secured within the storage container by a cylindrical joint that facilitates its rotation between a vertical, stowed position and a horizontal, extended position. A securement element positioned on an opposite wall aids in holding the shower rod in its horizontal position during use. The shower curtain is attached to the shower rod and can be neatly stored within the in-wall container when the shower is not in use. Notably, the in-wall storage container extends below the top of the tub, enabling the curtain to hang without bunching at the bottom, and is constructed from a mold-resistant material, thereby enhancing the longevity of the assembly. This invention provides an elegant solution to the management of shower curtains, reducing visible clutter and contributing to a more organized and aesthetically pleasing bathroom environment.

In order to do this, in one aspect of the invention, a shower curtain rod hideaway is provided, comprising: an in-wall storage container configured to be installed in a shower stall or tub enclosure, the in-wall storage container including a door; a shower rod configured to be stowed in the in-wall storage container when not in use; a cylindrical joint attached to an inner surface of the in-wall storage container, the cylindrical joint configured to secure a proximal end of the shower rod and enable rotation of the shower rod from a vertical position to a horizontal position; a securement element located on a wall opposite the in-wall storage container in the shower stall or tub enclosure, the securement element configured to secure a distal end of the shower rod in the horizontal position; and, a shower curtain coupled to the shower rod, the shower curtain configured to be stored in the in-wall storage container when not in use.

In one embodiment, the shower rod comprises a perpendicular section, a curved section, a main section, and a telescoping section, the perpendicular section being perpendicular to the main section and defining the proximal end, and the telescoping section defining the distal end. In one embodiment, the in-wall storage container extends below the top of a tub in the shower or tub enclosure, allowing a stowed curtain to hang without bunching on the bottom. In one embodiment, the in-wall storage container is constructed with a material resistant to mold growth. In one embodiment, the door of the in-wall storage container includes hinges and a handle to facilitate opening and closing of the door. In one embodiment, the shower rod is configured to rotate approximately 90 degrees from a stowed vertical position to an extended horizontal position. In another embodiment, the telescoping section of the shower rod is configured to extend and be removably attached to the securement element on the opposite wall when in the extended horizontal position.

The foregoing has outlined rather broadly the more pertinent and important features of the present disclosure so that the detailed description of the invention that follows may be better understood and so that the present contribution to the art can be more fully appreciated. Additional features of the invention, which will be described hereinafter, form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a shower curtain rod hideaway.

It is to be understood that the terminology used herein is for the purpose of describing particular embodiments only and is not intended to be limiting. The terms "a" or "an," as used herein, are defined as to mean "at least one." The term "plurality," as used herein, is defined as two or more. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time. These terms generally refer to a range of numbers that one of skill in the art would consider equivalent to the recited values (i.e., having the same function or result). In many instances these terms may include numbers that are rounded to the nearest significant figure.

Figure 1:
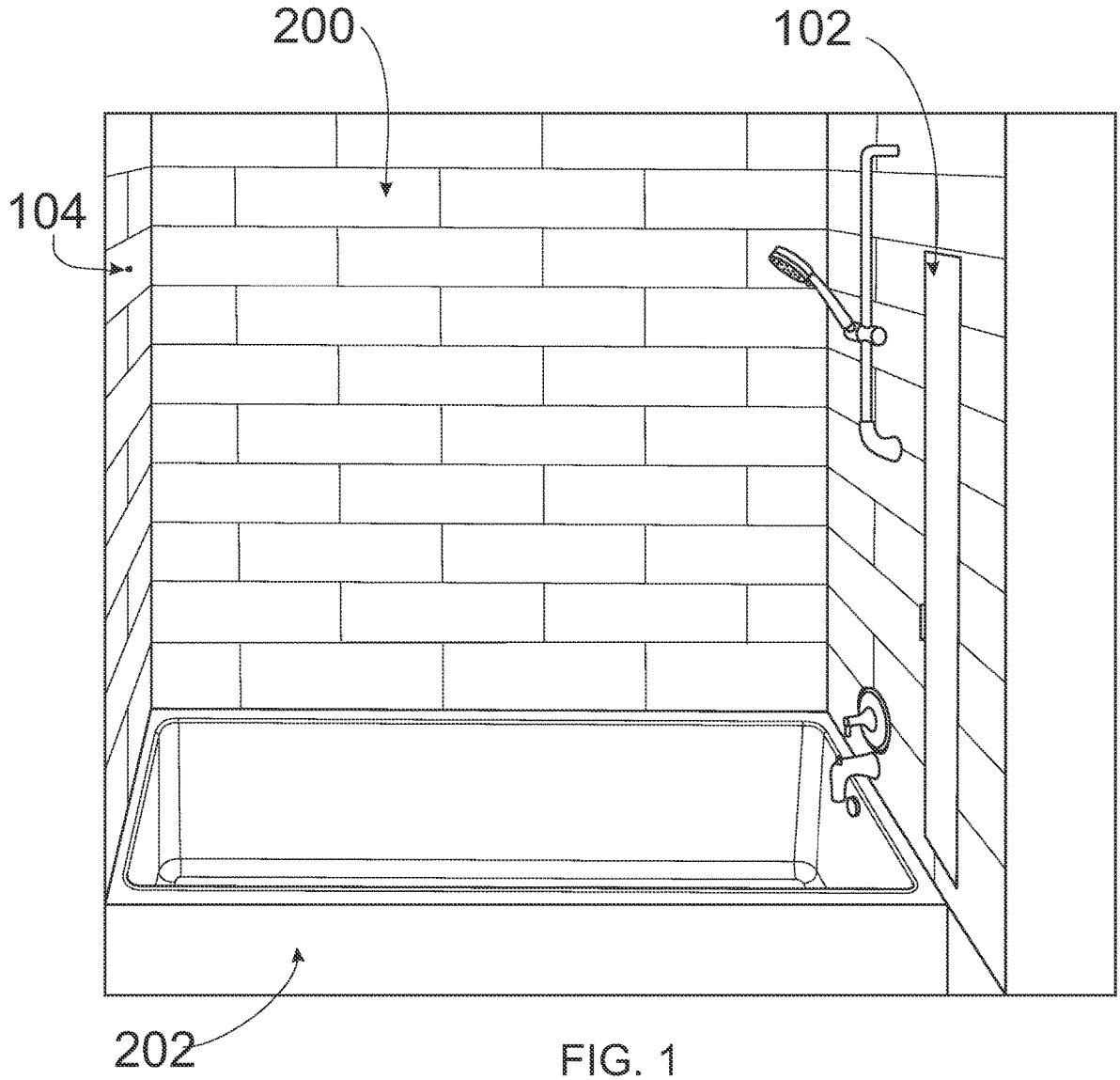
FIG. 1 is a shower curtain rod hideaway in a stowed position according to an embodiment of the present invention.

FIG. 1 illustrates a shower curtain rod hideaway in a stowed position according to an embodiment of the present invention. Referring to FIG. 1, the assembly is designed for installation in a shower stall or tub enclosure 200. The example given shows a tub enclosure 200 fitted with a tub 202. The door 102 of the in-wall storage container is in a closed position. In one embodiment, the assembly includes a securement element 104 located on a wall adjacent to, and opposite of, the door 102. The securement element 104 is designed to secure the shower rod in an extended position, a feature that will be discussed in greater detail below. In this representation, FIG. 1 displays the present invention in a concealed position when not in use. In this state, no unsightly shower curtain is visible.

Figure 2:
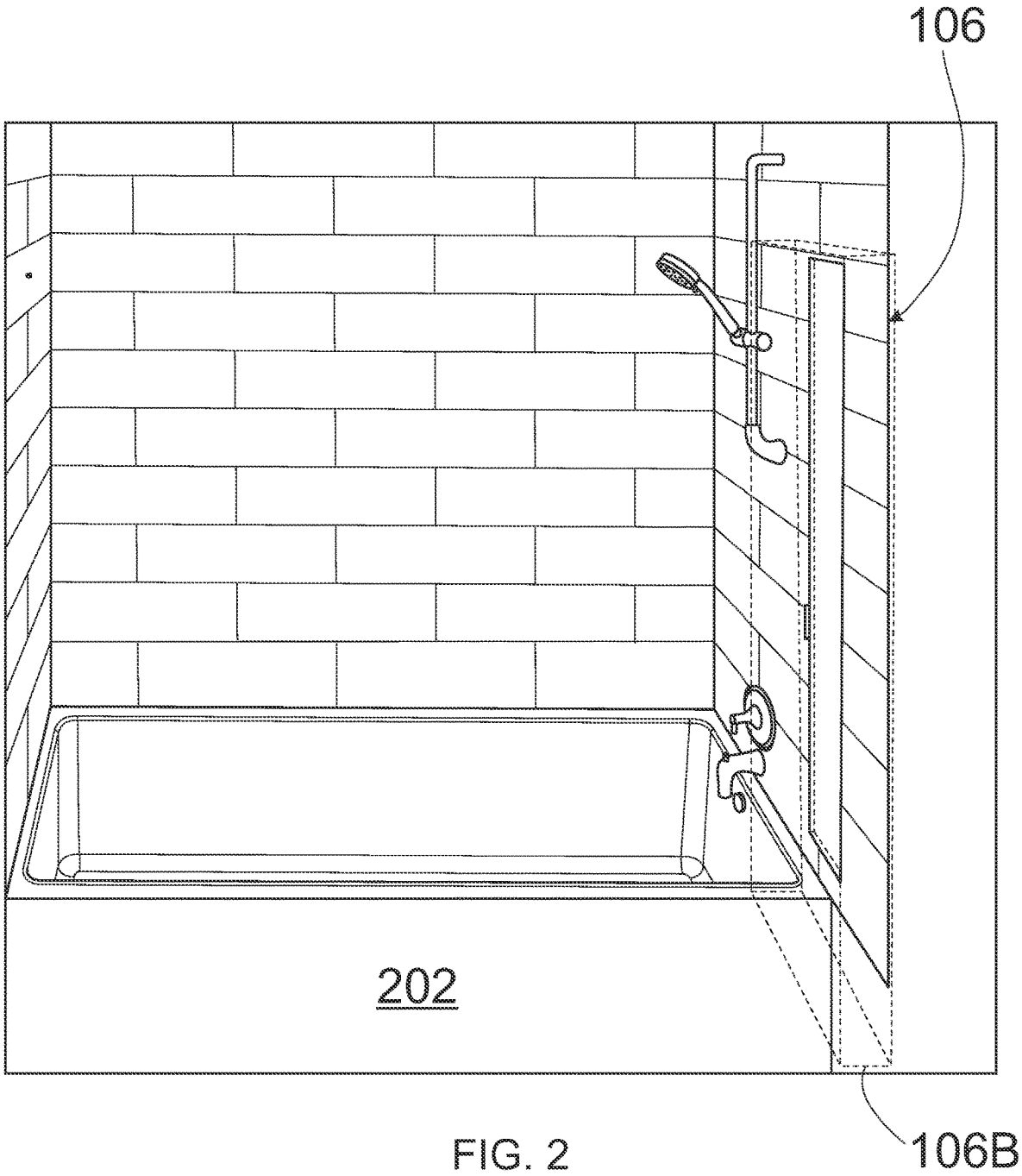
FIG. 2 is a transparent view of FIG. 1 showing the in-wall storage container according to an embodiment of the present invention.

FIG. 2 provides a transparent view of FIG. 1, showing the in-wall storage container according to an embodiment of the present invention. Referencing FIG. 2, the external volume and area of the in-wall container 106 are visible. It is important to note that the bottom of the in-wall container 106 extends below the top edge or rim of the tub 202. This design advantageously allows a stowed curtain to hang freely, preventing bunching at the bottom and mitigating moisture-related problems such as mold. The structure of the in-wall storage container can be constructed with various materials, but moisture-related issues should be considered. In one embodiment, the external structure of the in-wall storage container is constructed with a mold-resistant material, such as plastic, ABC, PVS, fiberglass, stainless steel, aluminum, or similar. The in-wall storage container should also be designed to prevent moisture from seeping into the walls, which could damage and compromise the building's structural elements. Those skilled in the art will appreciate the necessary steps, including the use of moisture barriers and construction techniques, required for safe installation of the present invention. While the design is primarily intended for new construction, it can also be adapted for retrofit assemblies, remodels, and similar installation.

Figure 3:
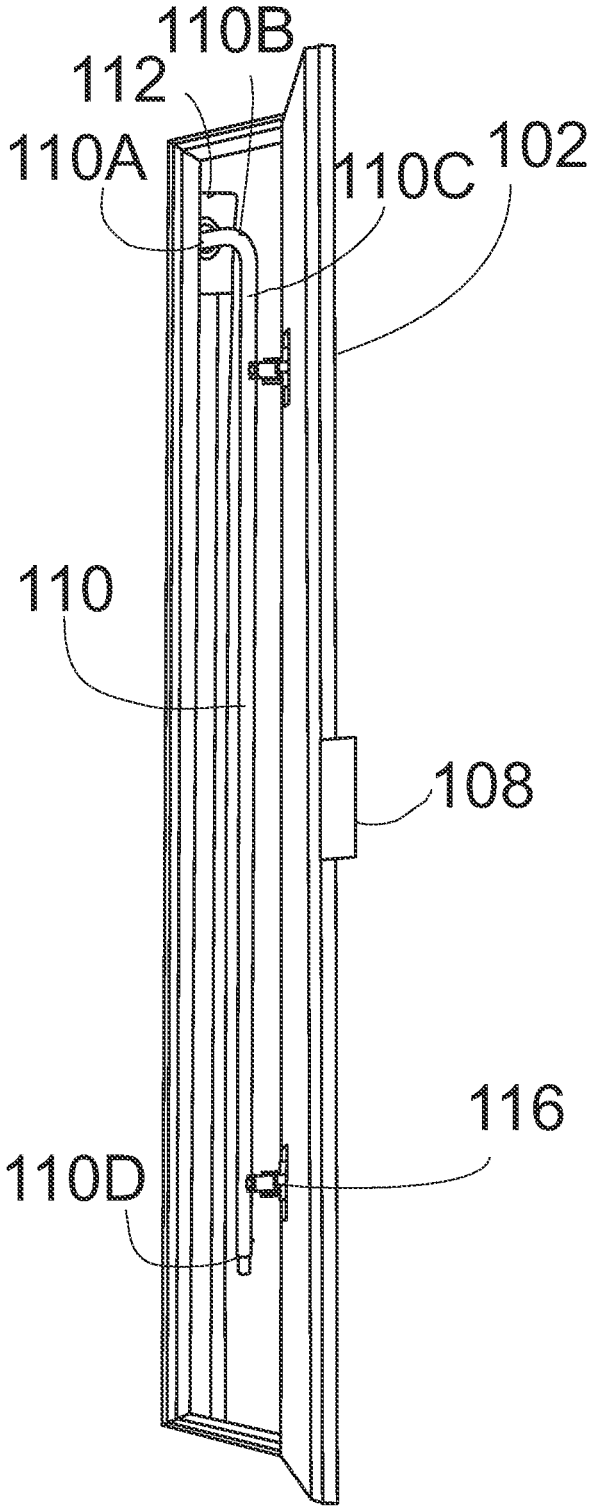
FIG. 3 is a detailed view of the in-wall storage container with the door in an open position according to an embodiment of the present invention.

FIG. 3 provides a detailed view of the in-wall storage container with the door in an open position according to an embodiment of the present invention. Referring to FIG. 3, in some embodiments, the assembly includes a shower rod 110, a shower curtain 112, the in-wall storage container 106, and the door 102 equipped with hinges 116 and handle 108 to facilitate the opening and closing of the door 102. The shower rod 110 may include a perpendicular section 100A, a curved section 110B, a main section 110C, and a telescoping section 110D. In one embodiment, the perpendicular section is substantially perpendicular to the main section of the shower rod. The perpendicular section defines one end of the shower rod designed to be rotatably attached to a portion of the inner wall of the in-wall storage container. This feature will be described in further detail below.

Figure 5:
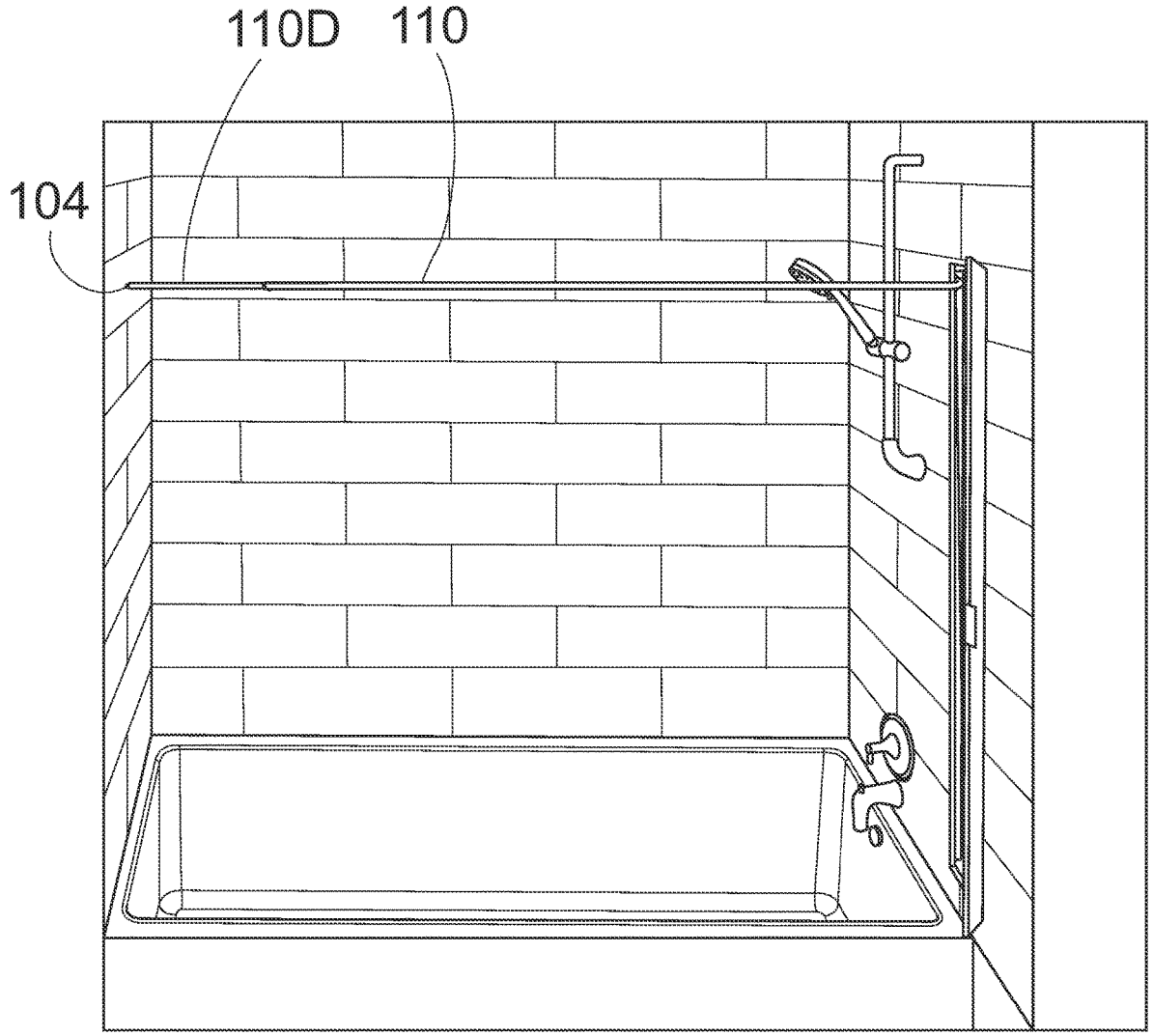
FIG. 5 is the shower curtain rod hideaway with the door in an open position and the shower rod fully extended and secured according to an embodiment of the present invention.
Figure 6:
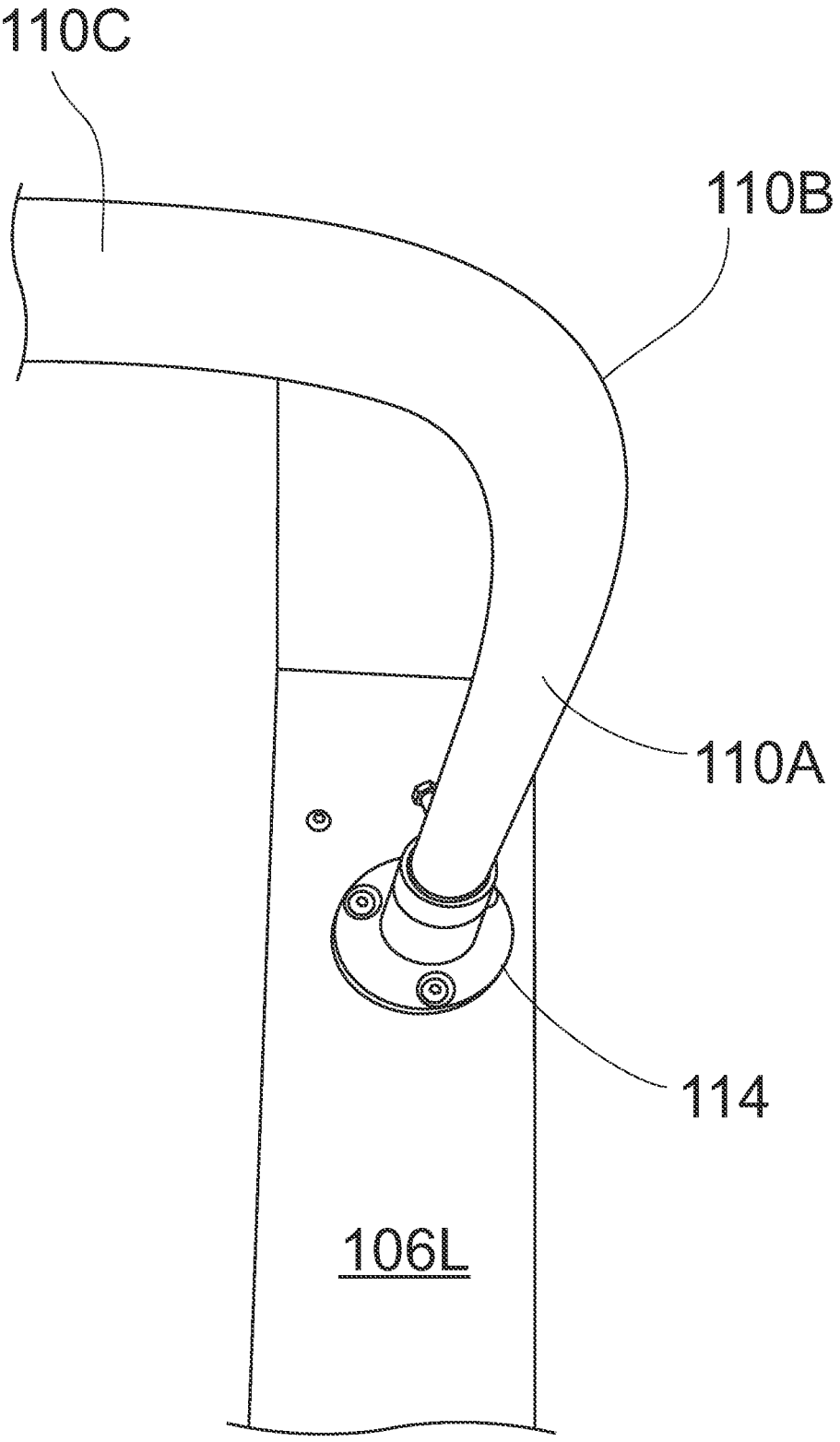
FIG. 6 is a detailed view of the hinge and a portion of the concealable shower rod according to an embodiment of the present invention.

FIG. 6 provides a detailed view of the hinge and the perpendicular section of the concealable shower rod according to an embodiment of the present invention. Referencing FIG. 6, the left side 106L of the in-wall storage container is depicted. In this view, the cylindrical joint 114 is visible, and is attached to the left side of the in-wall storage container using any suitable fastener or attachment method well known in the art. The cylindrical joint serves as an anchor for the proximal end of the shower rod, enabling 360 degrees of rotation for the perpendicular section 110A. However, due to the walls of the in-wall storage container, the full range of motion is not possible nor required for use. The actual range of motion needed for use is approximately 90 degrees, i.e., from a vertical position to a horizontal position towards the opposite wall and securement element. The curved section 110B and main section 110C are visible in this view. Due to the design of the shower rod, it is configured to rotate such that the main section 110C can transition from a vertical position to a horizontal position. This functionality can be visualized with reference to FIGS. 4-5.

Figure 4:
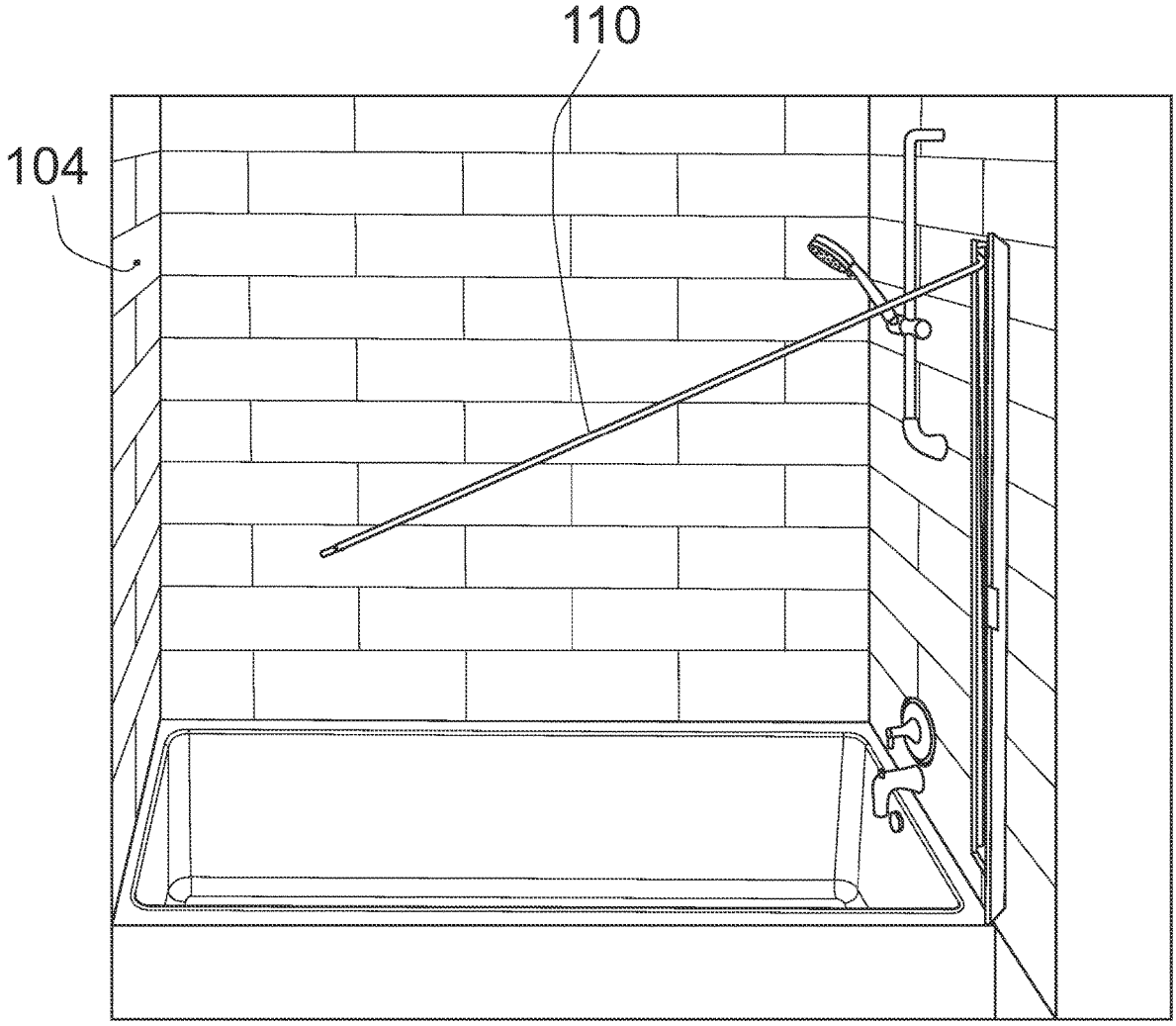
FIG. 4 is the shower curtain rod hideaway with the door in an open position and the shower rod mid extension according to an embodiment of the present invention.

Specifically, FIG. 4 shows the shower rod 110 at mid-extension, rotated approximately 45 degrees from the stowed vertical position. In FIG. 5, the shower rod is fully rotated to a horizontal position, and the telescoping section 110D is extended such that it is removably attached to the securement element 104 on the opposite wall, as previously discussed.

Figure 7:
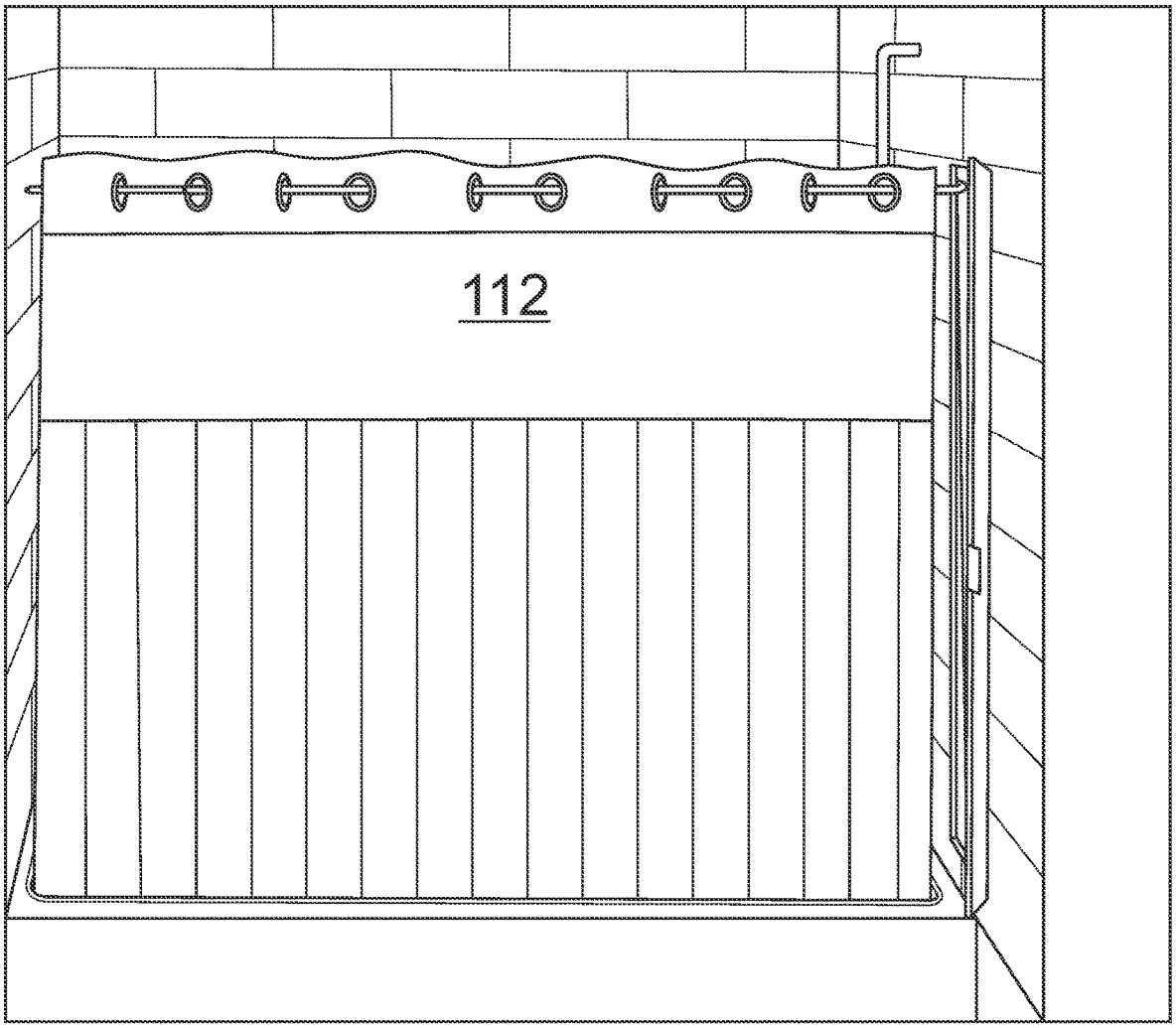
FIG. 7 is the shower curtain rod hideaway with the door in an open position and the shower rod fully extended and secured with the shower curtain fully extended and ready for use according to an embodiment of the present invention.

Finally, as shown in FIG. 7, the shower rod is fully extended and secured, with the shower curtain 112 also fully extended and ready for use. After use, for instance, showering, once the curtain is dry, it can be retracted back within the in-wall storage container. The telescoping section 110D of the shower rod is then removed from the securement element and retracted within the main section of the shower rod 100C. Following this, the shower rod 110 is rotated back into a stowed vertical position within the in-wall storage container, and the door 102 can be closed.

It should be understood that the materials used for various elements of the assembly may vary. In some embodiments, the shower rod is designed to be constructed from stainless steel. The curtain may consist of one or two layers of fabric and/or plastic. Any curtain rings, loops, or similar may be used. The interior portion of the door should be constructed with the same or similar materials as the in-wall storage container. The exterior portion of the door should be constructed from materials that match or complement the shower enclosure, such as tile, ceramic, porcelain, fiberglass, acrylic, or other common materials.

The shower curtain rod hideaway of the present invention offers several advantages over traditional shower rods and curtains. For example, the concealable design of the assembly allows for a cleaner, more streamlined appearance in the bathroom when the shower is not in use. This can be particularly beneficial in smaller bathrooms or in situations where aesthetics are of significant importance. Furthermore, the use of an in-wall storage container helps to keep the shower curtain out of sight when not in use, reducing visible clutter and contributing to a more organized bathroom environment.

The use of a cylindrical joint and a securement element provides flexibility and functionality in the use of the shower rod. The cylindrical joint allows the shower rod to rotate from a vertical to a horizontal position, allowing it to be easily extended when needed and stowed away when not in use. The securement element provides stability and security when the shower rod is in use, ensuring that it remains in place during showering.

The in-wall storage container is strategically designed to extend below the top of the tub in the shower stall or tub enclosure. This design feature allows the curtain to hang freely without bunching at the bottom, which can help to prevent the build-up of moisture and reduce the risk of mold growth. Furthermore, the in-wall storage container is constructed from a material that is resistant to mold growth, further enhancing the durability and longevity of the assembly.

The door of the in-wall storage container includes hinges and a handle, allowing for easy access to the shower rod and curtain. When the shower is not in use, the door can be easily closed to conceal the shower rod and curtain within the in-wall storage container. This feature adds to the overall convenience and usability of the assembly. Further, when the door is open, the door helps retain the shower curtain in position during use.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. In other words, the terminology and phraseology used in this description and the abstract are for illustrative purposes and should not be considered limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention. For example, while the in-wall storage container is described as being constructed from a material resistant to mold growth, other materials with similar properties may be used. Similarly, while the assembly is described as being installed in a shower stall or tub enclosure, it may be suitable for use in other types of enclosures or environments as well.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, references to "first," "second," "third," and so fourth members throughout the disclosure (and in particular, claims) are not used to show a serial or numerical limitation but instead are used to distinguish or identify the various members of the group.

What is claimed is:

1. A shower curtain rod hideaway, comprising:

an in-wall storage container configured for installation in a shower stall or tub enclosure, the in-wall storage container having a height, a width, and a depth, wherein the width has an open portion and a closed portion forming a total width, the open portion having an opening width less than the total width;

a door configured to cover the open portion;

a shower rod configured to be stowed within the in-wall storage container when not in use in a vertical position, the shower rod having a proximal end and a distal end;

a cylindrical joint secured to an inner surface of the in-wall storage container, the cylindrical joint is rotatably attached to the proximal end of the shower rod, wherein the cylindrical joint is configured to enable rotation of the shower rod from the vertical position to a horizontal position and from the horizontal position to the vertical position;

a location on a wall opposite the in-wall storage container for securing and receiving the distal end of the shower rod;

a shower curtain attached to the shower rod, the shower curtain designed to be stored within the in-wall storage container when not in use when the shower rod is in a vertical position; and wherein the closed portion is positioned behind the shower stall or tub enclosure such that the inner surface and the cylindrical joint are concealed and not located directly behind the open portion; and, wherein the shower rod includes a perpendicular section, a curved section, a main section, and a telescoping section, with the perpendicular section being perpendicular to the main section and defining the proximal end, and the telescoping section defining the distal end, wherein the shower curtain is positioned on the perpendicular section of the shower rod when not in use.

2. The assembly of claim 1, wherein the in-wall storage container extends below a top edge of a tub in the shower stall or tub enclosure, allowing a stowed curtain to hang freely without bunching at the bottom.

3. The assembly of claim 1, wherein the in-wall storage container is constructed from a material that is resistant to mold growth.

4. The assembly of claim 1, wherein the door of the in-wall storage container is fitted with hinges and a handle, facilitating the opening and closing of the door.

5. The assembly of claim 1, wherein the shower rod is configured to rotate 90 degrees from a stowed vertical position to an extended horizontal position.

6. The assembly of claim 5, wherein the telescoping section of the shower rod is configured to extend and be removably attached to the securement element on the opposing wall when in the extended horizontal position.

* * * * *